US008317951B2

(12) United States Patent
Parizat

(10) Patent No.: US 8,317,951 B2
(45) Date of Patent: Nov. 27, 2012

(54) MICRO GAS GENERATOR

(75) Inventor: Amnon Parizat, Old Westbury, NY (US)

(73) Assignee: Island Pyrochemical Industries Corp., Mineola, NY (US)

( * ) Notice: Subject to any disclaimer, the term of this patent is extended or adjusted under 35 U.S.C. 154(b) by 117 days.

(21) Appl. No.: 12/658,535

(22) Filed: Feb. 8, 2010

(65) Prior Publication Data

US 2011/0194985 A1 Aug. 11, 2011

(51) Int. Cl.
*D03D 23/00* (2006.01)
*D03D 43/00* (2006.01)

(52) U.S. Cl. .... 149/2; 149/108.2; 149/109.2; 149/109.4

(58) Field of Classification Search ..... 149/2, 108.2, 149/109.2, 109.4
See application file for complete search history.

(56) References Cited

U.S. PATENT DOCUMENTS 5,829,784 A * 11/1998 Brown et al. ..... 280/737
* cited by examiner

*Primary Examiner* — James McDonough
(74) *Attorney, Agent, or Firm* — Francis C. Hand; Carella, Byrne, et al

(57) ABSTRACT

The micro gas generator employs a liquid propellant, e.g. 50% to 60% by weight hydroxyl ammonium nitrate as an oxidizer, 16% to 22% triethyl ammonium nitrate as fuel, 21% to 28% water as a diluent to provide stability and 1% to 3% additives. The liquid propellant is housed in a can mounted in sealed relation on a retainer in which an initiator is also mounted.

6 Claims, 2 Drawing Sheets

MICRO GAS GENERATOR

This invention relates to a micro gas generator. More particularly, this invention relates to a liquid propellant micro gas generator. Still more particularly, this invention relates to a liquid propellant micro gas generators used in vehicle occupant protection/safety systems and their components, such as airbag inflators, seatbelt pretensioners, and active head restraints.

As is known, gas generators used in seat belt pretensioners are called Micro Gas Generators (MGG), for example, as defined in U.S. Pat. No. 7,438,313. Micro gas generators contain an initiator also known as a squib comprising an initiator charge and a secondary booster charge, e.g. a gas generating composition, typically in powder form which ignites and burns in response to the ignition of the initiator. The gas generated is used as a mechanism to activate the seat belt pretensioner. The gas generated can also be used as ignition elements for various pyrotechnic airbag inflators.

Secondary powder booster charges are know to generate after combustion excessive amounts of harmful gas containing Carbon Monoxide, Carbon Dioxide, Formaldehyde, Chlorine, Nitrogen Monoxide, Nitrogen Dioxide, Cobalt Chloride, Hydrochloric Acid, Sulfur dioxide, Benzene, and the like. As described in U.S. Pat. No. 6,136,111, two common propellants used in airbag or seatbelt tensioning systems are nitrocellulose and $BKNO_3$. Nitrocellulose is usually an unstable composition that degrades rapidly at the conditions present within an automobile's interior. Nitrocellulose also produces large amounts of NO, $NO_2$ and carbon monoxide to which a person is exposed when an airbag or seatbelt pretensioner activates. $BKNO_3$ is a fairly stable material at the conditions present within an automobile's interior, but, when ignited, produces large amounts of NO and $NO_2$. U.S. Pat. No. 6,136,111 proposes to use a solid propellant comprised of a fuel, an oxidizer, and a binding agent, wherein the fuel comprises pentaerythritol and the binding agent comprises a fluoroelastomer.

Accordingly, it is an object of the invention to provide suitable combustionable compositions in the form of a liquid propellant to be used in airbags and pretensioners which produce little or no NO, NO2, carbon monoxide, SOx, HCL, NH3, or HF.

It is another object of the invention to replace a secondary powder booster charge with a liquid propellant charge.

It is another object of the invention to provide a bulk, bag, container, or semi-rigid packaging material to hold the liquid propellant.

It is another object of the invention to generate a gas that meets or exceeds all effluent requirements as stated in the SAE/USCAR TR and others, and reduce the levels of harmful gas.

It is another object of the invention to provide a high gas yield from a very compact size.

It is another object of the invention to provide a gas generated with minimum sensitivity to ambient temperature extremes.

Briefly, the invention provides a micro gas generator that is of compact construction and that comprises a retainer in which an initiator of conventional structure is mounted for generating a combustible mixture and a can that is mounted in sealed relation on the retainer and disposed about the initiator.

In accordance with the invention, a liquid propellant is disposed in the can for combusting in response to a combustible mixture being expelled from the initiator. In particular, the liquid propellant is composed of 50% to 60% by weight hydroxyl ammonium nitrate as an oxidizer, 16% to 22% triethyl ammonium nitrate as fuel, 21% to 28% water as a diluent to provide stability of the propellant and additives of from 1% to 3%. A preferred composition is 56% hydroxyl ammonium nitrate, 19% triethyl ammonium nitrate and 25% water.

Upon activation of the initiator, the liquid propellant combusts and generates a volume of clean expanding gas.

The clean gas generated from the liquid propellant has drastically reduced levels of substances/particles considered important by NIOSH (the US National Institute of Occupational Safety and Health) such as Carbon Monoxide, Formaldehyde, Nitrogen Monoxide, Nitrogen Dioxide, and the like.

In the case of a seat belt pretensioner, an electric signal is sent to the initiator during a crash. The electric signal ignites the initiator charge leading to the ignition and combustion of the liquid propellant. The liquid propellant generates gas which in turn causes the seatbelt to tighten putting the occupant in the correct position.

In the case of an airbag inflator, an electric signal is sent to the initiator during a crash. The electric signal ignites the initiator charge leading to the ignition and combustion of the liquid propellant. The liquid propellant generates gas which in turn causes ignition and combustion of the gas generating composition inside the inflator. The gas generated by the inflator inflates the airbag which absorbs the energy received from the occupant.

In operation of the micro gas generator, upon activation of the initiator, heat and pressure develop inside the can and the liquid propellant ignites thereby opening the base of the can releasing the gas generated. In this respect, the can is constructed so that the base of the can ruptures under the heat and pressure developed by the expanding gas.

These and other objects and advantages of the invention will become more apparent taken in conjunction with the accompanying drawings wherein.

Figure 1:
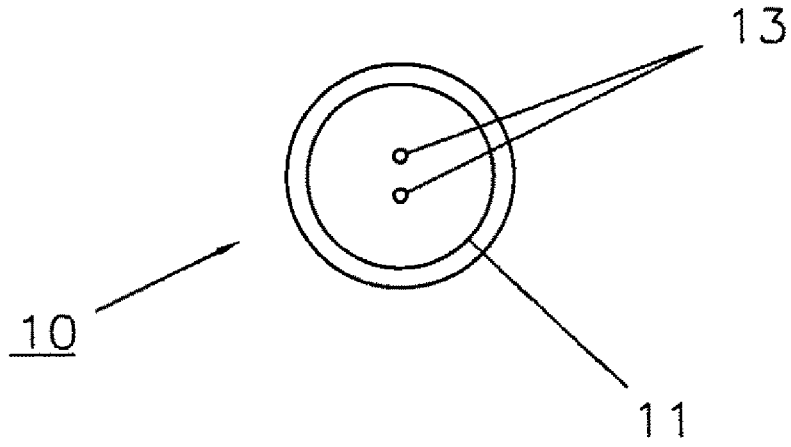
FIG. 1 illustrates a top view of a micro gas generator constructed in accordance with the invention.
Figure 2:
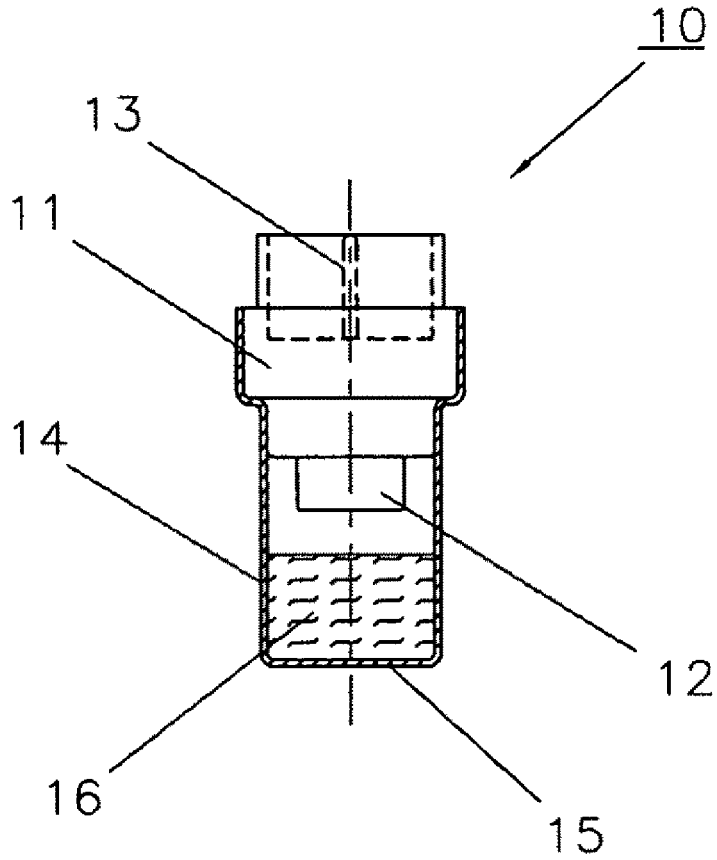
FIG. 2 illustrates a cross sectional view of the micro gas generator of FIG. 1.

Referring to FIGS. 1 and 2, the micro gas generator 10 is constructed to be used, for example, as a seat belt pretensioner in a vehicle. As shown, the micro gas generator 10 has a retainer 11 and an initiator 12 mounted on the retainer 11 for generating a combustible mixture. The retainer 11 and initiator 12 are of conventional structure. In this respect, the retainer 11 is provided with a pair of pin contacts 13 for receiving an electric signal in a conventional manner from a sensing device (not shown) indicative of a crash of the vehicle and a need for a seat belt to be pretensioned. The pin contacts 13, in turn, ignite a charge in the initiator 12.

The micro gas generator 10 also has a can 14 that is mounted in sealed relation on the retainer 11 and that is disposed circumferentially about the initiator 12 in spaced relation. The can 14 may be made of metal and be secured to the retainer 11 as by welding or any other suitable technique. The can 14 may also have a lining on the interior of high density polyethylene. Alternatively, the can 14 may be made entirely of high density polyethylene.

The can 14 is constructed with a base 15 that can be ruptured in response to a predetermined temperature and pressure developed within the can 14 in the confined space between the retainer 11 and the can 14.

The micro gas generator 10 also has a liquid propellant 16 disposed within the can 14 for combusting in response to a combustible mixture being expelled from the initiator 12. This liquid propellant has 56% by weight hydroxyl ammonium nitrate as an oxidizer, 19% triethyl ammonium nitrate as fuel and at least 20% water as a diluent to provide stability of the propellant.

Figure 3:
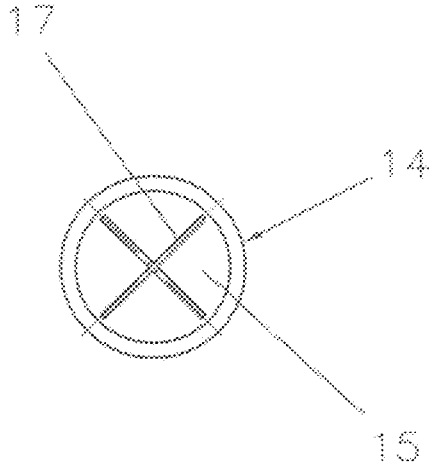
FIG. 3 illustrates a bottom view of the can.

Referring to FIG. 3, in order to avoid a random rupture, the bottom of the can 14 is scored with a star shaped groove 17 with a gradual depth. The groove 17 is deeper in the center and shallower at the radial edge of the can 14. As viewed, the groove 17 has four radially disposed sections. This shape of the groove 17 ensures that the base 15 of the can 14 will open in a predicted manner (petal opening).

Figure 4:
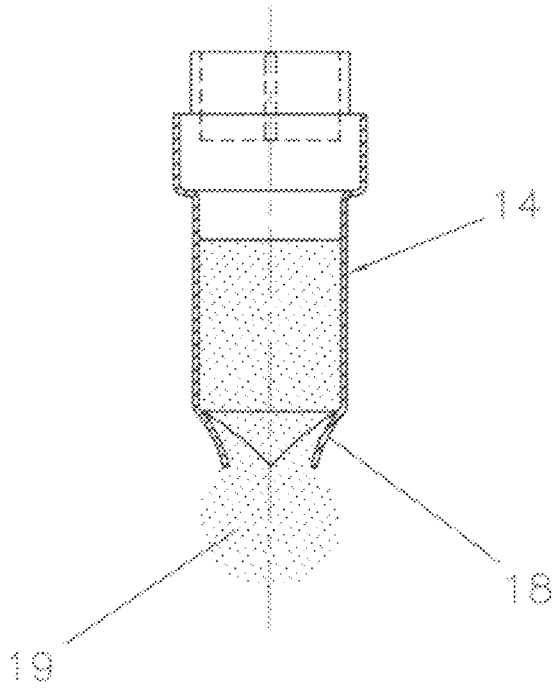
FIG. 4 illustrates a side view of the can after rupturing of the base of the can.

Referring to FIG. 4, under the temperature and pressure developed in the can 14, the base 15 ruptures along the scored groove 17 and opens in petal fashion to form an opening defined by four petals 18 and through which the hot combusted propellant gas 19 exits the can 14. Since the petals 18 remain attached to the can 14 in an integral manner and are not broken, loose broken pieces of the can are avoided in the system. Thus, the risk of damage and contamination to the system by broken pieces of the can 14 is eliminated.

In operation, an electric signal is sent to the initiator 12 during a crash via the pin contacts 13. The electric signal ignites the initiator charge (not shown) leading to the generation of a combustible mixture being expelled from the initiator 12 into the can 14 for ignition and combustion of the liquid propellant 16 in the can 14. The liquid propellant 16, in turn, combusts to generate a volume of gas within the can 14. Upon the temperature and pressure of the generated gas in the can reaching predetermined levels, the base 15 of the can 14 ruptures thereby allowing the expanding gas to cause a tensioning of a seat belt in an otherwise conventional manner, for example, the expanding gas causes the seatbelt to tighten placing an occupant in the correct position.

The liquid propellant 16 is a stable composition that can be readily prepared and stored. The liquid propellant performance has minimum sensitivity to ambient temperature extremes. This means that at plus 85 C and minus 40 C, the gas output will not change significantly (5-10%) when compared with powdered booster propellants that change from 15 to 20%.

The liquid propellant 16 only combusts via the initiator 12 and produces little or no NO, NO2, carbon monoxide, SOx, HCL, NH3, or HF.

The micro gas generator 10 is of a very compact size but generates a high gas yield. For example, the liquid propellant has a high gas molar output of 0.0447 per each gram of propellant. This is normally twice the output rate of a conventional powder propellant booster charge.

As the liquid propellant can be corrosive to a can 14 made of a metal, such as aluminum, the can 14 should be lined with a high density polyethylene or be made of such a plastic. Alternatively, the liquid propellant 16 may be placed in a bag or semi-rigid container that is non-corrosive relative to the propellant and of a size to fit into the can 14 and be sealed in place.

The invention thus provides a micro gas generator that can be used in vehicle occupant protection/safety systems and their components, such as airbag inflators, seatbelt pretensioners, and active head restraints.

The invention also provides a micro gas generator that generates a gas that meets or exceeds all effluent requirements as stated in the SAE/USCAR TR and others, and reduces the levels of harmful gas.

The invention also provides a micro gas generator that generates a gas with minimum sensitivity to ambient temperature extremes.

What is claimed is:

1. A micro gas generator comprising
a retainer;
an initiator mounted on said retainer for generating a combustible mixture;
a can mounted in sealed relation on said retainer and disposed about said initiator, said can being made of metal and having a lining of high density polyethylene exposed to said liquid propellant; and
a liquid propellant in said can for combusting in response to a combustible mixture being expelled from said initiator.

2. A micro gas generator comprising
a retainer;
an initiator mounted on said retainer for generating a combustible mixture;
a can mounted in sealed relation on said retainer and disposed about said initiator, said can being made of high density polyethylene; and
a liquid propellant in said can for combusting in response to a combustible mixture being expelled from said initiator.

3. A micro gas generator comprising
a retainer;
an initiator mounted on said retainer for generating a combustible mixture;
a can mounted in sealed relation on said retainer and disposed about said initiator;
a liquid propellant in said can for combusting in response to a combustible mixture being expelled from said initiator; and
a bag of high density polyethylene containing said liquid propellant and disposed in said can.

4. A micro gas generator comprising
a retainer;
an initiator mounted on said retainer for generating a combustible mixture;
a can mounted in sealed relation on said retainer and disposed about said initiator; and
a liquid propellant in said can between said initiator and said base for combusting in response to a combustible mixture being expelled from said initiator
said can having a base with a scored groove therein for rupturing of said base therealong under the temperature and pressure of combusted propellant in said can into a plurality of integral petals to define an opening for the passage of the combusted propellant.

5. A micro gas generator as set forth in claim 4 wherein said groove is star shaped with a plurality of radially disposed sections.

6. A micro gas generator comprising
a retainer;
an initiator mounted on said retainer for generating a combustible mixture;
a can mounted in sealed relation on said retainer and disposed about said initiator, said can being made of metal and having a lining of high density polyethylene exposed to said liquid propellant; and.
a liquid propellant in said can for combusting in response to a combustible mixture being expelled from said initiator
wherein said can has a base that is rupturable in response to a predetermined temperature and pressure within said can in said confined space.

* * * * *